US008287326B2

(12) United States Patent
Huang et al.

(10) Patent No.: US 8,287,326 B2
(45) Date of Patent: Oct. 16, 2012

(54) REMOTE CONTROLLER FOR AIRCRAFT MODEL

(75) Inventors: Guochuan Huang, Zhejiang Province (CN); Yuchen Wu, Shanghai (CN)

(73) Assignee: Shanghai Nine Eagles Electronic Technology Co., Ltd., Shanghai (CN)

( * ) Notice: Subject to any disclaimer, the term of this patent is extended or adjusted under 35 U.S.C. 154(b) by 483 days.

(21) Appl. No.: 12/554,309

(22) Filed: Sep. 4, 2009

(65) Prior Publication Data

US 2010/0125366 A1 May 20, 2010

(30) Foreign Application Priority Data

Nov. 14, 2008 (CN) ..... 2008 1 0202731

(51) Int. Cl.
*A63H 27/04* (2006.01)

(52) U.S. Cl. ..... 446/31

(58) Field of Classification Search ..... 446/30
See application file for complete search history.

(56) References Cited

U.S. PATENT DOCUMENTS 4,969,647 A * 11/1990 Mical et al. ..... 463/31
6,494,786 B2 * 12/2002 Oshita ..... 463/46
6,764,400 B1 * 7/2004 Yokoi et al. ..... 463/36
2004/0082269 A1 * 4/2004 Wright ..... 446/456
2005/0119051 A1 * 6/2005 Ko ..... 463/37

OTHER PUBLICATIONS

Cockpit MM transmitter Manual, Jun. 9, 2004, http://web.archive.org/web/20040609112612/http://www.multiplexusa.com/Support/manuals/Cockpit_MM_GB.PDF, pp. 1-48.*

Japanese Notice of Reasons for Rejection of Japan Application No. 2009-260343, dated on Nov. 22, 2011.

* cited by examiner

*Primary Examiner* — Tramar Harper
(74) *Attorney, Agent, or Firm* — J.C. Patents

(57) ABSTRACT

The present invention relates to a remote controller for an aircraft model, which includes a body, a mode selection switch, and a signal acquisition unit. The body is adapted to be held in a first direction and a second direction. The mode selection switch may be configured to issue a mode selection signal. The signal acquisition unit acquires the manipulation signals manipulated by the first joystick and the second joystick in the remote controller, and processes the manipulation signals according to the mode selection signal, so as to enable the remote controller to operate respectively in the first manipulation mode and the second manipulation mode. The remote controller of the present invention merely switches the electric signals for switching between the manipulation modes without modifying the mechanical structure, thereby simplifying the switching operations.

9 Claims, 10 Drawing Sheets

REMOTE CONTROLLER FOR AIRCRAFT MODEL

CROSS-REFERENCE TO RELATED APPLICATIONS

This application claims priority to Chinese Patent Application No. 200810202731.9, filed on Nov. 14, 2008, which is incorporated herein by reference in its entirety.

FIELD OF THE TECHNOLOGY

The present invention relates to the field of aircraft models, and more particularly to the design of remote controllers for aircraft models.

BACKGROUND OF THE INVENTION

Most of the remote controllers for present prevailing aircraft models have similar mechanical structures and joystick arrangements. FIG. 1A schematically illustrates a structure of such remote controller 100. A body 10 is configured with two joysticks 11*a*, 12*a* on the right and left respectively, with each joystick being able to be manipulated in the forth, back, right, and left directions. However, the manipulation modes for remote controllers are classified into an Asian Mode (also referred to as Mode 1, or generally as "Japanese-hand") and an American Mode (also referred to as Mode 2, or generally as "American-hand") due to historical reasons.

Mode 1 is widely utilized by aircraft model amateurs in Asian countries. FIG. 2A schematically illustrates the manipulation mode of Mode 1. The forth-back movements of a first joystick 11*a* on the right are used to control the momentum of the remote-controlled model, which is referred to as a throttle and defined as Channel 3. The right-left movements of the first joystick on the right are used to control the lateral of the model helicopter (or to control the ailerons of the model for a fixed-wing model aircraft), which is defined as Channel 1. While the forth-back movements of a second joystick 12*a* on the left are used to control the forward or backward of the model helicopter (or to control the elevator for a fixed-wing aircraft to cause the aircraft to dive or climb), which is defined as Channel 2. The right-left movements of the second joystick 12*a* on the left are used to control the head orientation of the model helicopter (or a rudder of a fixed-wing aircraft), which is defined as Channel 4.

Most American users prefer Mode 2. FIG. 1B and FIG. 2B schematically illustrate the manipulation mode of Mode 2. As that in Mode 1, in Mode 2, the right-left movements of the joystick 11*b* on the right are also used to control the lateral of the model helicopter (or to control the ailerons of the model for a fixed-wing aircraft), which is defined as Channel 1; and the right-left movements of the joystick 12*b* on the left are also used to control the head orientation of the model aircraft (or a rudder of a fixed-wing aircraft), which is defined as Channel 4. However, unlike Mode 1, in Mode 2, the forth-back movements of the joystick 11*b* on the right are used to control the forward or backward (or elevator) of the model helicopter, which is defined as Channel 2; and the forth-back movements of the joystick 12*b* on the left are used to control the momentum, which is defined as Channel 3. In other words, the objects controlled by the forth-back movements exchange with each other in Mode 1 and Mode 2, i.e., the positions of Channel 2 and Channel 3 are exchanged.

While in the Europe, users employ the remote controllers of both Mode 1 and Mode 2 for aircraft models.

Since the Europe and America, as well as the Asia all have huge markets, the remote controllers of both modes are under heavy market demand. Manufacturers are required to produce remote controllers of different modes for different markets, which is disadvantageous for mass production and cost reduction. Meanwhile it is inconvenient for European vendors, especially that every country has a few users who use remote controllers of a mode different from the majority. In an international communication scene, technical communications is hindered due to different manipulation modes. Therefore, the industry expects a remote controller with both manipulation modes, which requires the remote controller to switch between the two modes.

Currently, some manufacturers provide the mode switch function for remote controllers. For example, a small switch may be used to select Mode 1 or Mode 2 in which the remote controller to operate. However, such mode switch function merely exchanges electric positions (i.e., exchanges the positions of Channel 2 and Channel 3), it is impossible to modify the internal mechanical structure of a remote controller merely by a small switch, since the manipulation of the throttle is different from that of the elevator. The standard joystick for a throttle starts to move from the bottom, continuously pushing the momentum of the model from zero power until the maximum power on the top. The joystick mechanism has damping more or less, which enables the joystick to retain at any position within the manipulation range. It retains at this position even though the hand is off from the joystick for the throttle, thereby keeping the power of the model momentum at a level controlled by the throttle joystick, and maintaining a stable flying state. However, the joystick for the elevator of Channel 2 manipulates in a forward or backward direction from a regress position at the middle. The joystick for the elevator is always under a regress elastic force, and will return back to the middle automatically once the hand is off. The two different types of manipulations are achieved by different internal mechanical structures of the joysticks. The remote controller with the positions of the electric signals being switched merely by a mode switch would not comply with the requirements of the standard if the mechanical structure of the remote controller does not change, since the left and right joysticks with different mechanical structures are at the former positions. In practice, the manipulations would be difficult and may cause flying accidents. To enable the current remote controllers being switchable between the two manipulation modes which comply with the requirements of the standard, it is more important to change the internal mechanical structure of the remote controller, in addition to switching the electric signals. However, the modification of the mechanical structure requires opening the housing of the remote controller, disassembling the joystick mechanism within the remote controller, and reassembling the corresponding switched parts according to the intended mode of the controller. This reconstruction has a high technique requirement and is very difficult for ordinary users. As can be seen, although the current remote controllers almost have a mode switch function, it is very difficult or complex for users to change the manipulation modes in practice.

SUMMARY OF THE INVENTION

The technical problem to be solved by the present invention is to provide a remote controller for an aircraft model, which enable a user to change the manipulation modes by simple operations.

To solve the above technical problem, the present invention provides a remote controller for an aircraft model, which includes a body, a plurality of fine tuning buttons, a mode selection switch, and a signal acquisition unit.

The body is configured with a first joystick and a second joystick for respectively manipulating potentiometers to rotate to issue manipulation signals in two manipulation channels, wherein the body is adapted to be held in a first direction and a second direction respectively, the first direction corresponds to a first manipulation mode of the remote controller, the second direction corresponds to a second manipulation mode of the remote controller, and the first direction is opposite to the second direction.

The plurality of fine tuning buttons is corresponding to the manipulation channels manipulated by the first joystick and the second joystick and configured to finely tune the manipulation signals.

The mode selection switch is configured to issue a mode selection signal.

The signal acquisition unit is adapted for acquiring the manipulation signals manipulated by the first joystick and the second joystick, and processing the manipulation signals according to the mode selection signal, wherein the signal acquisition unit processes the manipulation signals according to the first manipulation mode when the mode selection signal selects the first manipulation mode, and the signal acquisition unit processes the manipulation signals according to the second manipulation mode when the mode selection signal selects the second manipulation mode.

In the above remote controller for an aircraft model, the first joystick manipulates a power of momentum of the aircraft model in forth-back direction, and the second joystick manipulates rise or fall of the aircraft model in forth-back direction.

In the above remote controller for an aircraft model, the mode selection switch is an electric switch.

In the above remote controller for an aircraft model, the mode selection switch comprises a first switch and a second switch provided on back of the body of the remote controller, and an antenna of the remote controller is adapted to rotate around a shaft on the back of the body, wherein the antenna presses the first switch while pointing to the first direction and presses the second switch while pointing to the second direction, and the remote controller is in the first manipulation mode when the first switch is pressed, and in the second manipulation mode when the second switch is pressed.

In the above remote controller for an aircraft model, the first manipulation mode is Mode 1, and the second manipulation mode is Mode 2.

In the above remote controller for an aircraft model, a first right-left signal and a first forth-back signal are generated when the first joystick is manipulated, and a second right-left signal and a second forth-back signal are generated when the second joystick is manipulated, wherein when the signal acquisition unit processes the signals according to the first manipulation mode, the first right-left signal corresponds to Channel 1 of the remote controller, the first forth-back signal corresponds to Channel 3 of the remote controller, the second right-left signal corresponds to Channel 4 of the remote controller, and the second forth-back signal corresponds to Channel 2 of the remote controller; and when the signal acquisition unit processes the signals according to the second manipulation mode, the first right-left signal corresponds to Channel 4 of the remote controller, the first forth-back signal corresponds to Channel 3 of the remote controller, the second right-left signal corresponds to Channel 1 of the remote controller, the second forth-back signal corresponds to Channel 2 of the remote controller and the manipulation signals are reversed.

In the above remote controller for an aircraft model, the first joystick and the second joystick are coupled to four potentiometers which generate the first right-left signal, the first forth-back signal, the second right-left signal, and the second forth-back signal according to manipulations of the first joystick and the second joystick.

In the above remote controller for an aircraft model, the fine tuning buttons include a set of fine tuning buttons, two sets of fine tuning buttons, a set of fine tuning buttons, and two sets of fine tuning buttons.

The set of fine tuning buttons of the inner of the first joystick are adapted for finely tuning a middle point of the first forth-back signal of the first joystick.

The two sets of fine tuning buttons are provided above and below the first joystick respectively for finely tuning a middle point of the first right-left signal of the first joystick.

The set of fine tuning buttons of the inner of the second joystick are adapted for finely tuning a middle point of the second forth-back signal of the second joystick.

The two sets of fine tuning buttons are provided above and below the second joystick respectively for finely tuning a middle point of the second right-left signal of the second joystick.

In the above remote controller for an aircraft model, the signal acquisition unit includes an analog/digital converter circuit and a micro-processor.

The analog/digital converter circuit is coupled to the four potentiometers for converting the first right-left signal, the first forth-back signal, the second right-left signal, and the second forth-back signal generated by the four potentiometers into digital signals.

The micro-processor is coupled to the analog/digital converter circuit and the mode selection switch for processing the first right-left signal, the first forth-back signal, the second right-left signal, and the second forth-back signal according to a manipulation mode selected by the mode selection signal.

Since the above technical schemes are employed, the remote controller for aircraft models of the present invention achieves the simple switching of the remote controller between two popular manipulation modes by smart mechanical structure design in association with necessary electric signal transitions. As compared with the prior remote controllers, all these processes do not require the modification of the mechanical structure of the remote controller, so the operation complexity is reduced and the operation time is saved. The switching between Mode 1 and Mode 2 may be achieved by simple operations at the flying scene. It is worth to mention that, the present invention enable the remote controllers for aircraft models not to be manufactured in terms of the manipulation modes. The design and manufacture of the two types of remote controllers are unified, thus reducing the manufacture cost, reducing the operation complexity for vendors, and better satisfying the requirements of users employing remote controllers of different modes.

BRIEF DESCRIPTION OF THE DRAWINGS

For more apparent and better understanding of the foregoing purposes, features and advantages of the present invention, the specific embodiments of the present invention will be described below in details in conjunction with the accompany drawings, wherein.

Figure 1A:
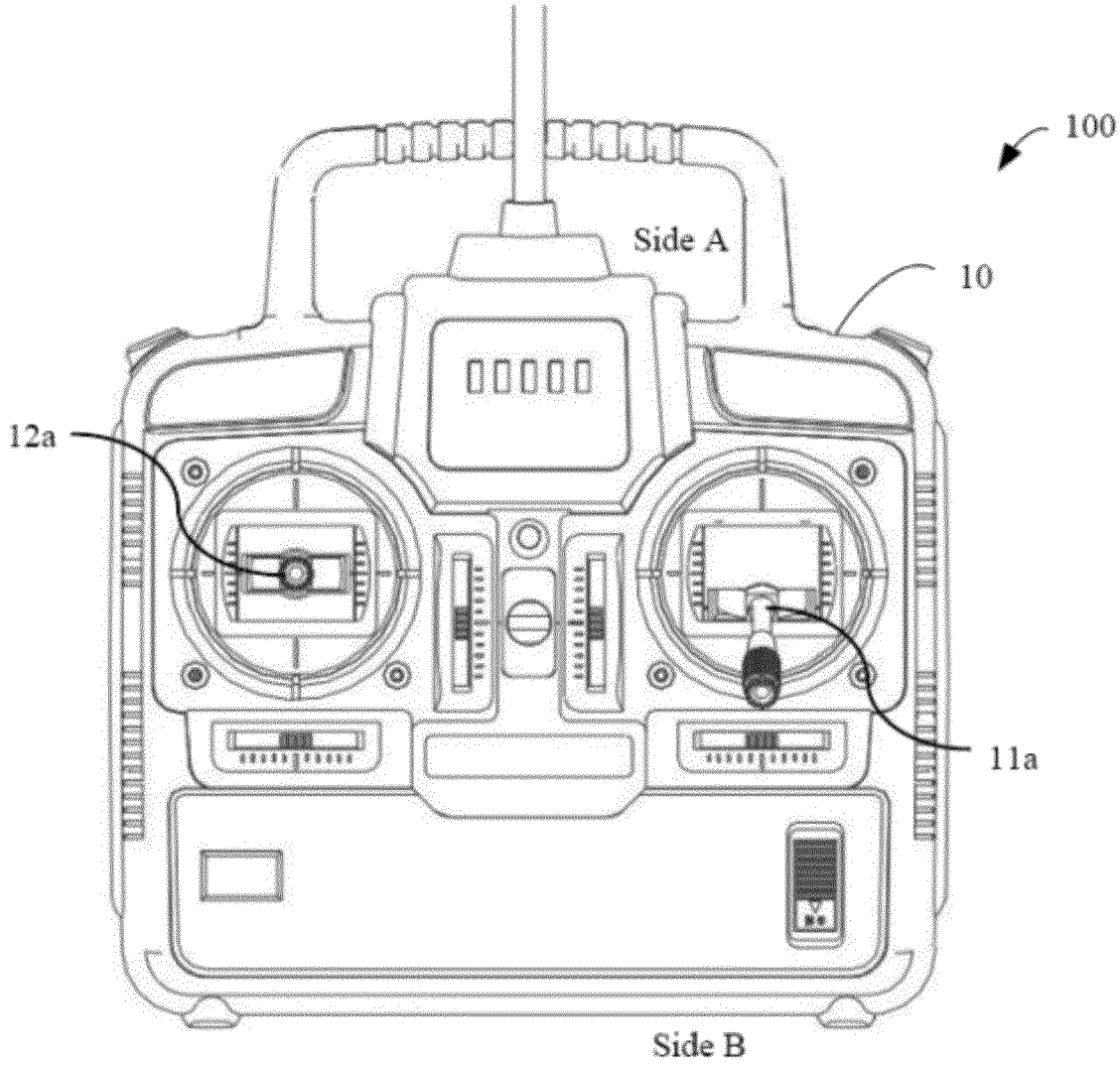
FIG. 1A illustrates a schematic diagram of the appearance and joystick arrangement of a remote controller that is widely employed currently, i.e., a conventional remote controller of Mode 1, for aircraft models.

| DESCRIPTION FOR SYMBOLS OF ELEMENTS IN THE DRAWINGS | |
|---|---|
| 1 | First Channel |
| 2 | Second Channel |
| 3 | Third Channel |
| 4 | Fourth Channel |
| 01 | Potentiometer manipulated by the joystick in the first channel |
| 02 | Potentiometer manipulated by the joystick in the second channel |
| 03 | Potentiometer manipulated by the joystick in the third channel |
| 04 | Potentiometer manipulated by the joystick in the fourth channel |
| 5 | Power Switch |
| 100 | Traditional Remote Controller |
| 10 | Body of the Traditional Remote Controller |
| 11a, 12a | Joysticks in Mode 1 |
| 11b, 12b | Joysticks in Mode 2 |
| 14-17, 26, 27 | Fine Tuning Buttons |
| 19 | Antenna Fixer |
| 200, 200a | Remote Controllers |
| 20, 20a | Bodies of the Remote Controllers |
| 21 | First Joystick |
| 22 | Second Joystick |
| 23, 23a | Mode Selection Switches |
| 25 | Antenna Shaft |
| 19 | Antenna Fixer |
| 32 | Analog/Digital Converter |
| 33 | Micro-processor |

-continued

| DESCRIPTION FOR SYMBOLS OF ELEMENTS IN THE DRAWINGS | |
|---|---|
| 34 | High Frequency Transmit Circuit |
| 35, 35a | Antennas |
| 36 | Display |

DETAILED DESCRIPTION OF THE PREFERRED EMBODIMENTS

Whereas the mode switching difficulty in the current remote controllers for aircraft models, the present invention achieves the switching of manipulation modes with extremely simple manipulation processes, by smart mechanical structure designs.

Figure 3A:
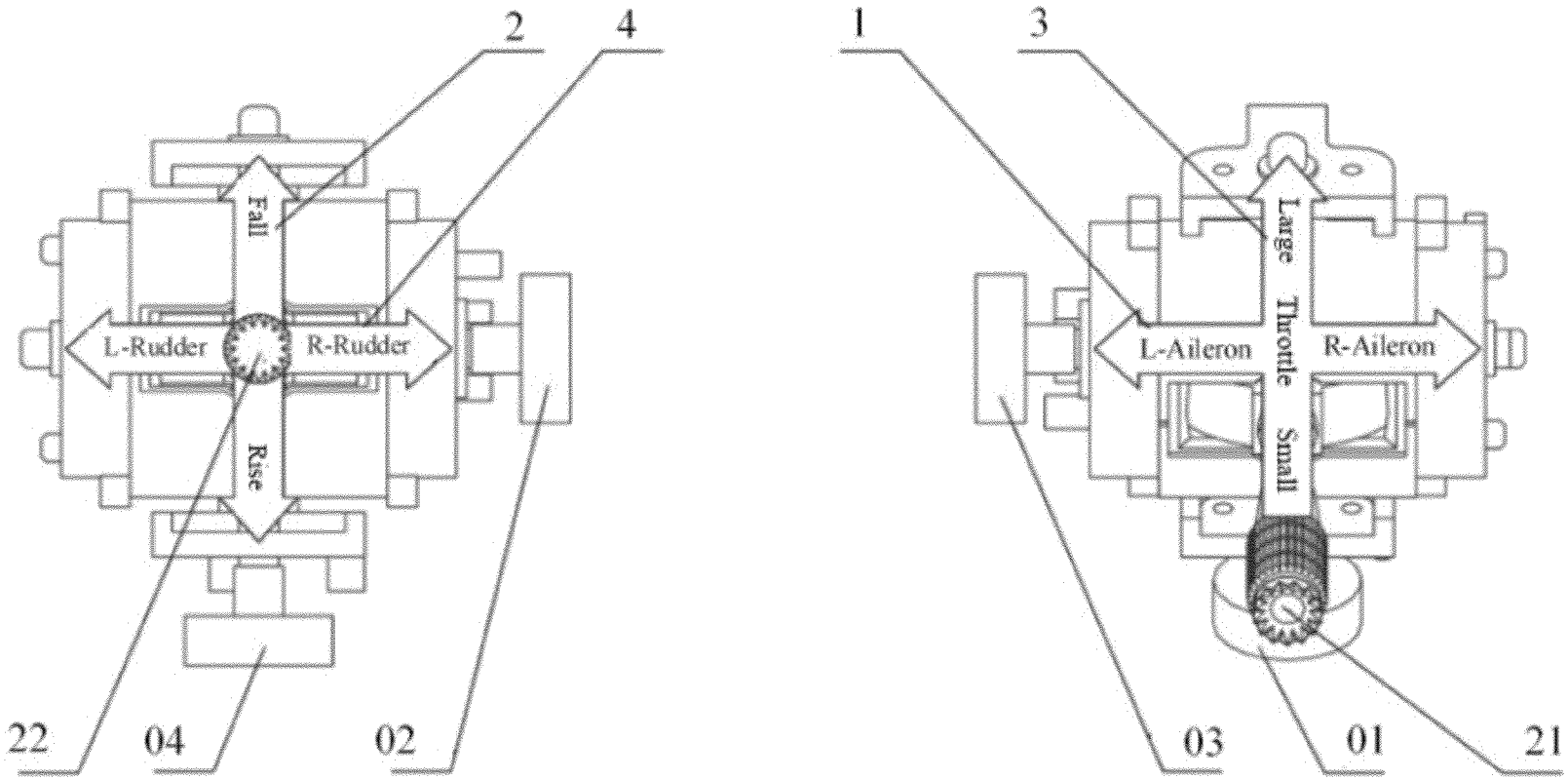
FIG. 3A illustrates a schematic diagram of a partial mechanism of a manipulation system for a remote controller in Mode 1 according to an embodiment of the present invention.

The basic concept of the present invention is a remote controller operable being rotated by 180°. From the perspective of the mechanical structure, if the remote controller of the Asian mode, i.e., Mode 1, is rotated by 180°, i.e., the top side A exchanges with the bottom side B, it is found that the mechanical structure and preference of the joysticks conform with the requirements of the America mode, i.e., Mode 2. Compare FIG. 3A with FIG. 3B, the throttle manipulation with damping characteristic was on the right joystick in Mode 1, while it is switched to the left joystick after the remote controller is rotated by 180°; the joystick as shown in FIG. 3C will meet the specification of Mode 2 as long as the throttle joystick is moved to the bottom in the direction as indicated by the dashed line in FIG. 3B. Moreover, the elevator manipulation with regress function on the left in Mode 1 is switched to the right after the remote controller is rotated by 180°. Thus, by means of rotating the remote controller by 180°, the mode switching between Mode 1 and Mode 2 may be achieved merely by necessary electric signals switching, without modifying the mechanical structure of the remote controller. Hence, the complicated operations such as opening the housing, disassembling and reassembling the components may be eliminated.

The embodiments of the present invention will be described in details below.

Figure 1B:
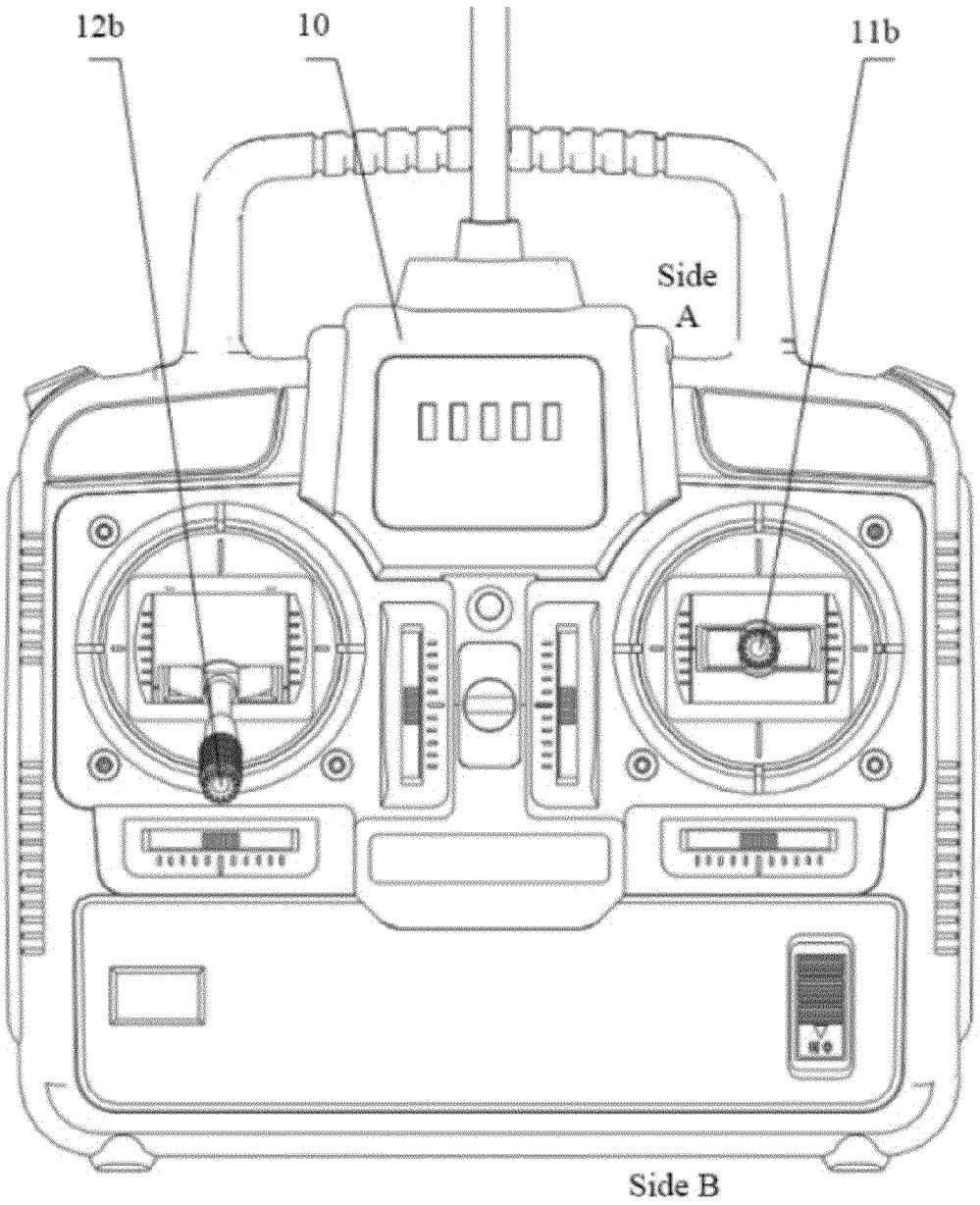
FIG. 1B illustrates a conventional remote controller of Mode 2.
Figure 2A:
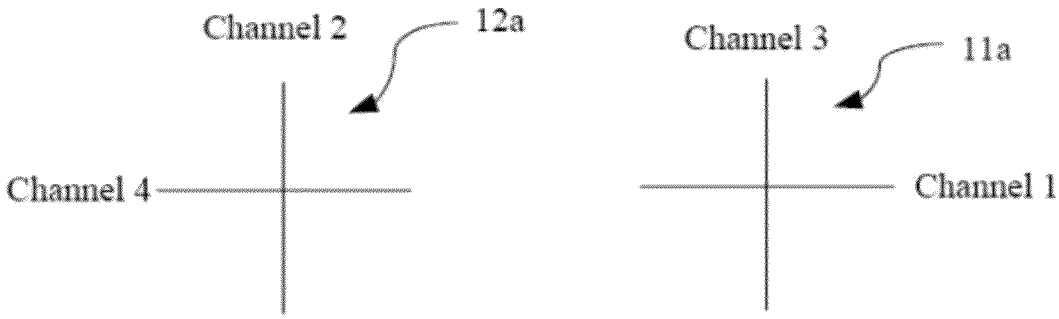
FIG. 2A illustrates a schematic diagram of a conventional remote controller in Mode 1.
Figure 2B:
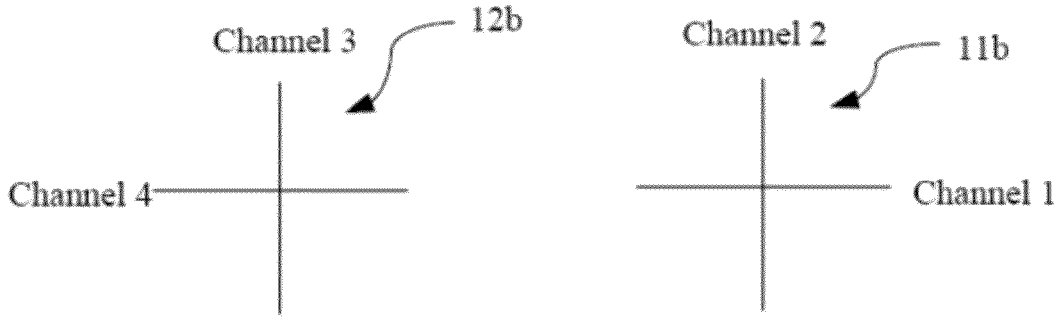
FIG. 2B illustrates a schematic diagram of a conventional remote controller in Mode 2.
Figure 4A:
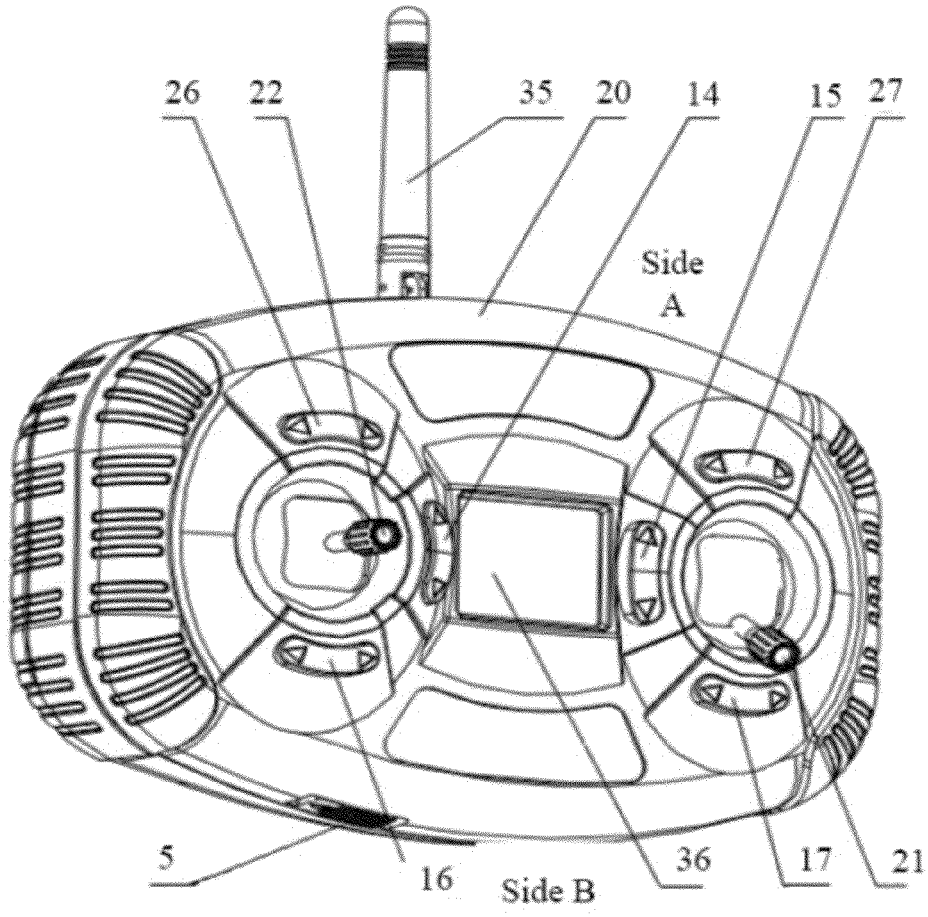
FIG. 4A illustrates a schematic diagram of a front structure of a remote controller in Mode 1 according to another embodiment of the present invention.
Figure 4B:
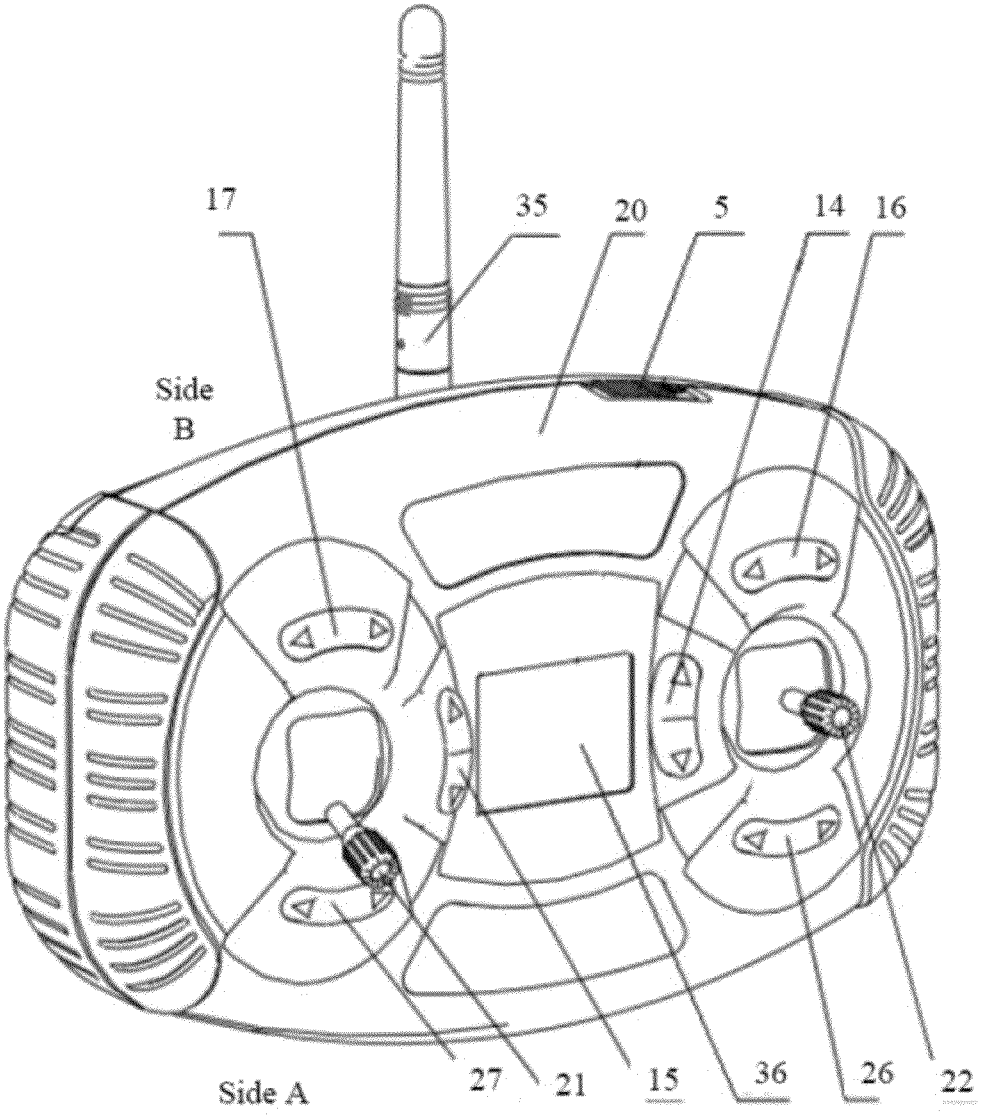
FIG. 4B illustrates a schematic diagram of a front structure of a remote controller in Mode 2 according to another embodiment of the present invention.

A remote controller 200 includes a body 20. Unlike the body 10 of the traditional remote controller shown in FIGS. 1A and 1B, the appearance of the body 20 of the present invention is designed as adapted to be held in a first direction (with side A upward as shown in FIG. 4A) and in a second direction (with side B upward as shown in FIG. 4B) that is opposite to the first direction respectively. As an example, the remote controller 200 operates in a first manipulation mode (e.g., Mode 1) as shown in FIG. 4A when the body 20 is held in the first direction; and the remote controller 200 operates in a second manipulation mode (e.g., Mode 2) as shown in FIG. 4B when the body 20 is held in the second direction. The body 20 may be ergonomically designed to improve the comfort for use. Preferably, the handhold part of the body is bilateral symmetric in appearance, thereby enabling the user to have the same holding feeling in either manipulation mode.

A first joystick 21 and a second joystick 22 are provided on the right and left of the body 20, respectively. In Mode 1 as shown in FIGS. 3A and 4A, the first joystick 21 is located on the right of the body 20, and the second joystick 22 is located on the left of the body 20. Each joystick may move left and right, as well as up and down.

Referring to FIGS. 3A and 4A, in Mode 1, a first right-left signal VR1 generated by rotating the potentiometer 01 by the right-left movements of the first joystick 21 corresponds to Channel 1 of the remote controller, i.e., for controlling the lateral of the model helicopter (or for controlling the ailerons of the model for a fixed-wing model aircraft). The right-and-left movements of the second joystick 21 have regress function so that the joystick returns back to the regress position in the middle automatically when the user's hand is off. A pair of fine tuning buttons 17 is located below the first joystick 21, for finely tuning the right-left position of the regress signal point of the first joystick 21 as necessary. A first forth-back signal VR3 generated by rotating the potentiometer 03 by the forth-and-back movements of the first joystick 21 corresponds to Channel 3 of the remote controller, i.e., for controlling the momentum of the remote-controlled model (i.e., manipulating the throttle). FIG. 3A and FIG. 4A illustrate a zero power position when the first joystick 21 is at the bottom. During the manipulation, upon pushing the first joystick, the model comes gradually to a power required for taking off, and is manipulated to take off and fly in the air. The forth-back movements of the first joystick 21 have damping characteristics, which enable the joystick to remain at the position where the user's hand is off, thereby maintaining the power of the model momentum at a level controlled by the throttle joystick, so as to maintain in a stable flying status. During the model is flying, the power of the model momentum increases when the first joystick is pushed forward, while the power of the model momentum decreases when the first joystick is drew back. A pair of fine tuning buttons 15 is located at the inner of the first joystick 21, for finely tuning the forth-back position of the zero power signal point of the first joystick 21 as necessary.

Referring to FIGS. 3A and 4A, in Mode 1, a second right-left signal VR4 generated by rotating the potentiometer 04 by the right-left movements of the second joystick 22 corresponds to Channel 4 of the remote controller, i.e., for controlling the head orientation of the model helicopter (or a rudder of a fixed-wing aircraft). A pair of fine tuning buttons 16 is located below the second joystick 22, for finely tuning the right-left position of the regress signal point of the second joystick 22 as necessary. A second forth-back signal VR2 generated by rotating the potentiometer 02 by the forth-back movements of the second joystick 22 corresponds to Channel 2 of the remote controller, i.e., for controlling the forward or backward of the model helicopter (or for controlling the elevator for a fixed-wing model aircraft to cause the aircraft to dive or climb). A pair of fine tuning buttons 14 is located at the inner of the second joystick 22, for finely tuning the forth-back position of the forth-back regress signal point of the second joystick 22 as necessary. Both the forth-back movements and the right-left movements of the second joystick 22 have regress function so that the joystick returns back to the regress position in the middle automatically when the user's hand is off.

While in Mode 2 as shown in FIG. 3C and FIG. 4B, the first joystick 21 is located on the left of the body 20, and the second joystick 22 is located on the right of the body 20.

In Mode 2, a first right-left signal VR1 generated by rotating the potentiometer 01 by the right-left movements of the first joystick 21 corresponds to Channel 4 of the remote controller, i.e., for controlling the head orientation of the model helicopter (or a rudder of a fixed-wing model aircraft). The right-left movements of the first joystick 21 have regress function so that the joystick returns back to the regress position in the middle automatically when the user's hand is off. A pair of fine tuning buttons 27 is located below the first joystick 21, for finely tuning the right-left position of the regress signal point of the first joystick 21 as necessary. A first forth-back signal VR3 generated by rotating the potentiometer 03 by the forth-back movements of the first joystick 21 corresponds to Channel 3 of the remote controller, i.e., for controlling the momentum of the remote-controlled model (i.e., manipulating the throttle). The forth-back movements of the first joystick 21 have damping characteristics, which enable the joystick to remain at the position where the user's hand is off. A pair of fine tuning buttons 15 is located at the inner of the first joystick 21, for finely tuning the forth-back position of the zero power signal point of the first joystick 21 as necessary.

In Mode 2, a second right-left signal VR4 generated by rotating the potentiometer 04 by the right-left movements of the second joystick 22 corresponds to Channel 1 of the remote controller, i.e., for controlling the lateral of the model helicopter (or for controlling the ailerons of the model for a fixed-wing model aircraft). A pair of fine tuning buttons 26 is located below the second joystick 22 for finely tuning the right-left position of the regress signal point of the second joystick 22 as necessary. A second forth-back signal VR2 generated by rotating the potentiometer 02 by the forth-back movements of the second joystick 22 corresponds to Channel 2 of the remote controller, i.e., for controlling the forward or backward of the model helicopter (or for controlling the elevator for a fixed-wing model aircraft to cause the model aircraft to dive or climb). A pair of fine tuning buttons 14 is located at the inner of the second joystick 22 for finely tuning the forth-back position of the forth-back regress signal point of the second joystick 22 as necessary. Both the forth-back movements and the right-left movements of the second joystick 22 have regress function so that the joystick returns back to the regress position in the middle automatically when the user's hand is off.

Figure 3B:
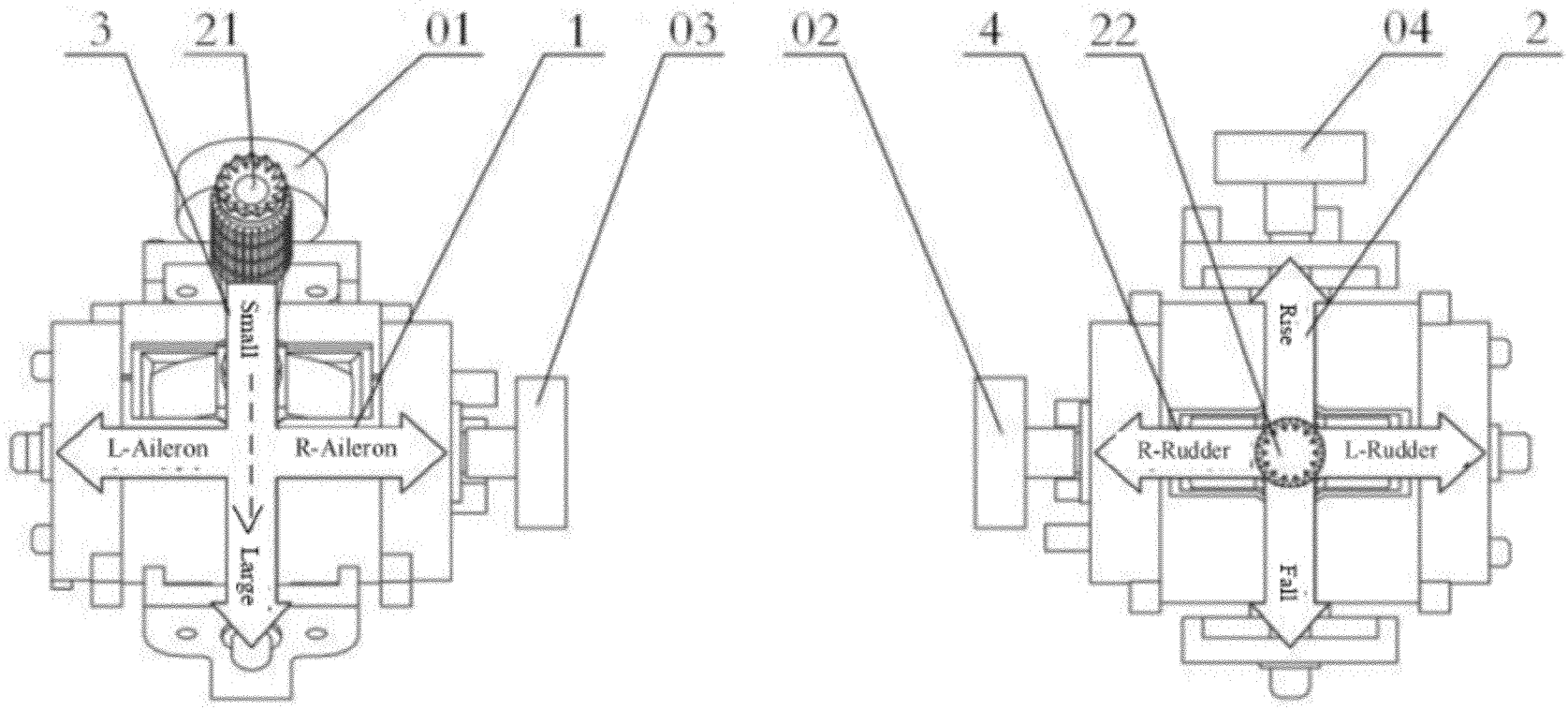
FIG. 3B illustrates a schematic diagram of a partial mechanism of a manipulation system for a remote controller in Mode 1 after rotated by 180° (without switching the electric signals), according to an embodiment of the present invention.
Figure 3C:
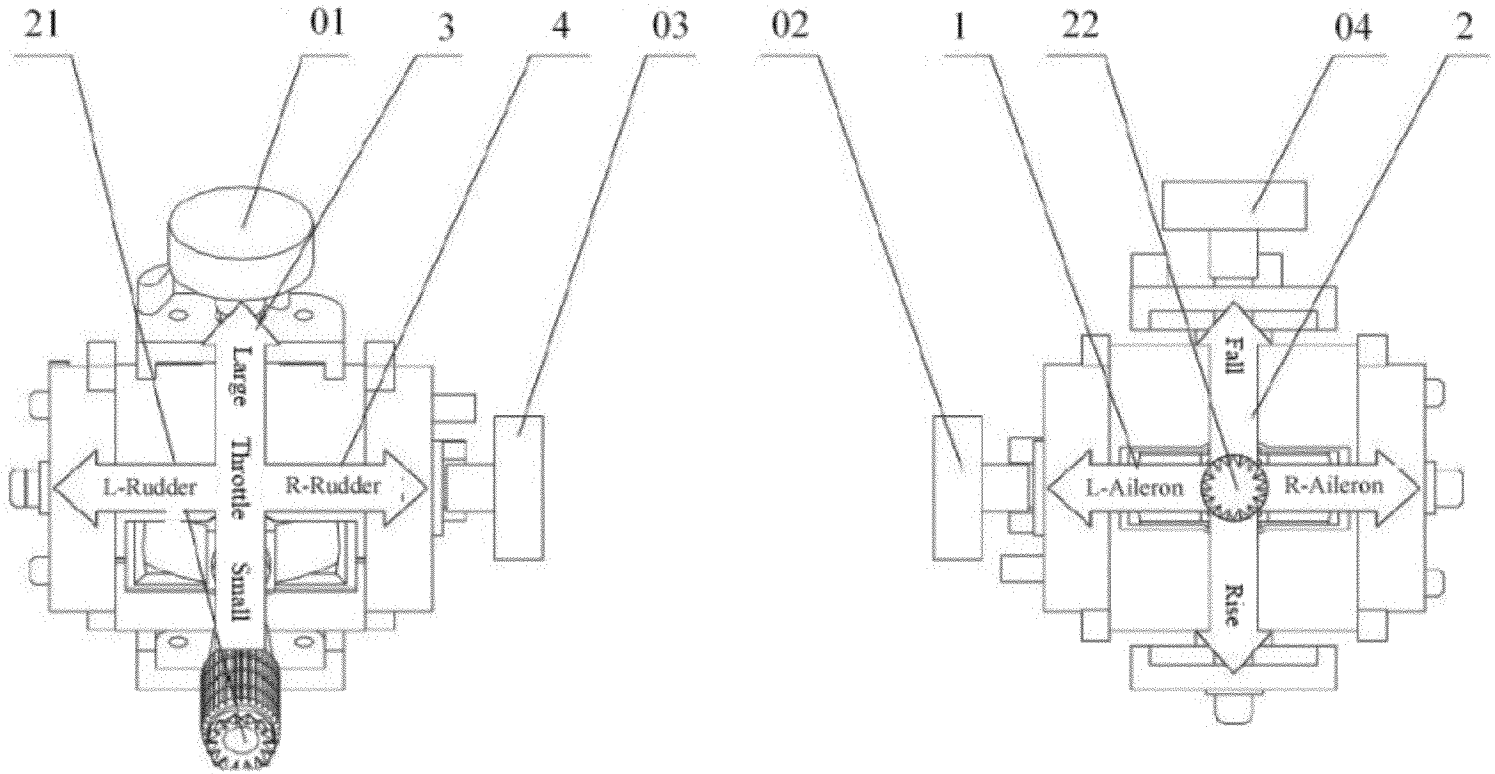
FIG. 3C illustrates a schematic diagram of a partial mechanism of a manipulation system for a remote controller in Mode 1 after rotated by 180° and switching the electric signals to Mode 2, according to an embodiment of the present invention.

As can be seen from the comparison between FIG. 3B and FIG. 3C, when the body 20 of the remote controller is rotated by 180°, the relations between the signals of the joysticks and the channels of the remote controller are changed significantly, as well as the manipulation directions. For example, for the first joystick 21 which is now located on the right of the remote controller after being rotated from Mode 1 (see FIG. 3B), the forth-back movements thereof are throttle control, with pushing the first joystick forward (upward in FIG. 3B) being throttle down, and drawing the first joystick back (upward in FIG. 3B) being throttle up. While in Mode 2, although the forth-back movements of the first joystick 21 are still throttle control, it requires the forward direction being throttle up and the backward direction being throttle down. The signals generated in the same manipulation direction in the two modes are completely opposite in direction, as well as other channels. Moreover, the directions of the corresponding fine tuning buttons are also opposite. Generally, when the remote controller in Mode 1 is rotated by 180°, the 8 directions of the manipulation signals corresponding to the various manipulation directions of the two joysticks in the 4 channels, as well as the fine tuning directions are opposite to the correct signal directions. Table 1 below illustrates the two joysticks, the corresponding manipulation channels, and the positions of the potentiometers in Mode 1 and Mode 2.

TABLE 1

| Comparisons between statuses of joysticks in Mode 1 and Mode 2 | | | | | | |
|---|---|---|---|---|---|---|
| | First Joystick | | | Second Joystick | | |
| | | Manipulation Direction | | | Manipulation Direction | |
| Manipulation Mode | Position | Forth-Back (throttle) | Right-Left | Position | Forth-Back | Right-Left |
| Mode1 | Right | Channel 3/ corresponding potentiometer 03-VR3 | Channel 1/ corresponding potentiometer 01-VR1 | Left | Channel 2/ corresponding potentiometer 02-VR2 | Channel 4/ corresponding potentiometer 04-VR4 |
| Mode2 | Left | Channel 3/ corresponding potentiometer 03-VR3 | Channel 4/ corresponding potentiometer 01-VR1 | Right | Channel 2/ corresponding potentiometer 02-VR2 | Channel 1/ corresponding potentiometer 04-VR4 |

If Mode 1 is the reference mode, the relations between the signals of the joysticks and the channels may be adjusted according to Table 1 when the mode is switched to Mode 2. It will be further illustrated below with an example.

Figure 6:
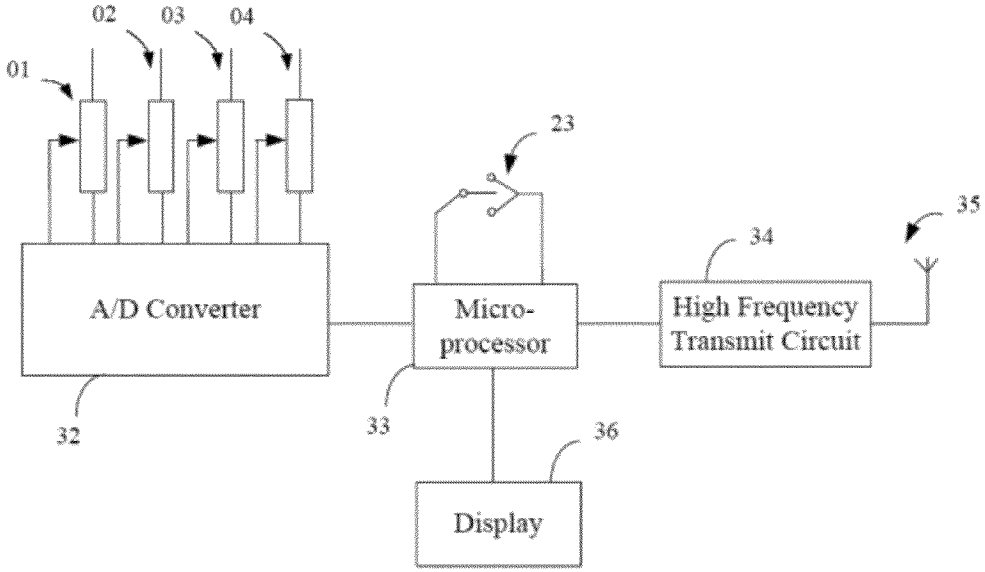
FIG. 6 illustrates a block diagram of an internal circuit structure of a remote controller according to an embodiment of the present invention.

FIG. 6 illustrates a block diagram of an internal circuit structure of a remote controller according to an embodiment of the present invention. A circuit 30 includes 4 potentiometers 01, 02, 03 and 04, a signal acquisition unit comprised of an analog/digital converter circuit 32 and a micro-processor 33, and a high frequency transmit circuit 34. The 4 potentiometers 01, 02, 03 and 04 correspond to the movements of the first joystick 21 and the second joystick 22 in 4 directions. The manipulations of each joystick in one channel are in linkage with a potentiometer. The signal voltage on the potentiometer varies as the position of the joystick changes, thereby generating the manipulation signal.

For example, in Mode 1, the potentiometer 01 generates the first right-left signal VR1 according to the right-left movements of the first joystick 21, the potentiometer 03 generates the first forth-back signal VR3 according to the forth-back movements of the first joystick 21, the potentiometer 04 generates the second right-left signal VR4 according to the right-left movements of the second joystick 22, and the potentiometer 02 generates the second forth-back signal VR2 according to the forth-back movements of the second joystick 22.

The signals VR1-VR4 pass through the analog/digital converter circuit 32, where the signal voltages are converted into digital signals VR1'-VR4' capable of being processed by the micro-processor 33, and are input to the micro-processor 33.

In addition, an electric switch is provided on the body 20 as a mode selection switch 23 (see FIG. 6), which is configured to issue a mode selection signal SEL. The mode selection signal SEL may select Mode 1 or Mode 2 as the current manipulation mode. The micro-processor will determine which mode the remote controller is in according to the mode selection signal SEL, and process the digital signals VR1'-VR4' above accordingly. When the mode selection signal SEL selects Mode 1, the micro-processor 33 will process the digital signals according to Mode 1, i.e., VR1' is considered as a signal for Channel 1, VR3' is considered as a signal for Channel 3, VR4' is considered as a signal for Channel 4, and VR2' is considered as a signal for Channel 2.

While when the mode selection signal SEL selects Mode 2, the micro-processor 33 will process the digital signals according to Mode 2, i.e., VR1' is considered as a signal for Channel 4, VR3' is considered as a signal for Channel 3, VR4' is considered as a signal for Channel 1, and VR2' is considered as a signal for Channel 2. It is worth to note that, since the manipulation signals generated by the potentiometers as manipulated by the joysticks, as well as the fine tuning directions after the remote controller is rotated have been reversed (see Table 2), the manipulations signals representative of the various manipulation directions should be reversed. For example, when the analog signals VR1-VR4 generated by the potentiometers 01-04 are converted into digital signals VR1'-VR4' of several bits, the digital signals VR1'-VR4' may be reversed by taking the complemental codes. From the illustration above, the above processes may be readily implemented by the micro-processor 33.

Thereafter, the digital signals of each channel are encoded by the micro-processor 33 to form a set of data in a predetermined format. This data is used to modulate the high frequency signals, transmitted by the high frequency transmit circuit 34 via the antenna 35, to control the aircraft model.

In an embodiment, a display 36 may be provided on the body 20 of the remote controller. When the remote controller is switched to Mode 2 from Mode 1, the processor 33 may adjust the orientation of the display.

It should be pointed out that, due to the characteristic that the body 20 of the remote controller is adapted to be held in both directions, the user is required to select the holding direction and the manipulation mode before use, so as to avoid accident caused by manipulation error. The manipulation mode corresponding to each holding direction may be indicated by a different identifier, and the current set manipulation mode may be indicated by an indicator light. The above purpose may be achieved reliably by establishing a relationship between the holding direction and the manipulation mode. For example, when a manipulation mode is selected by the mode selection switch, the corresponding holding direction that should be selected may be prompted by the indicator light or the display.

As an instance, a further embodiment being capable of reliably indicating the holding direction is given.

Figure 5A:
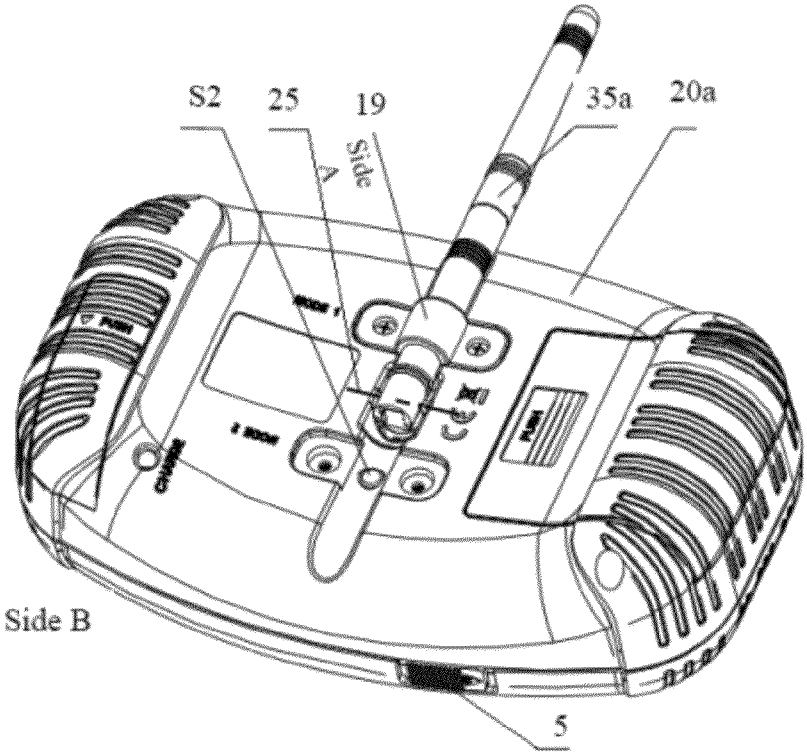
FIG. 5A illustrates a schematic diagram of a rear structure of a remote controller in Mode 1 according to another embodiment of the present invention.
Figure 5B:
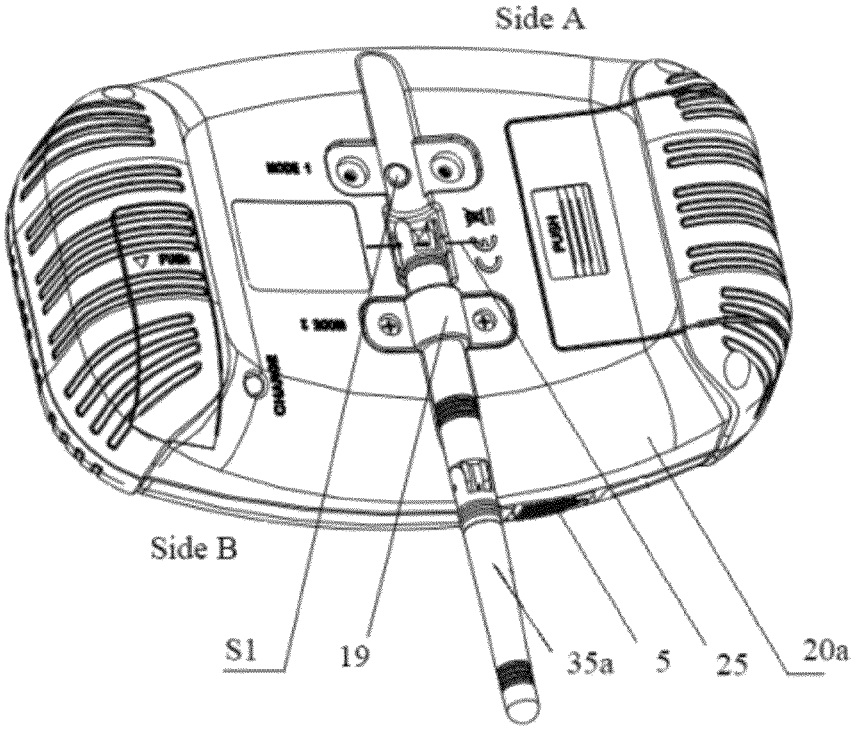
FIG. 5B illustrates a schematic diagram of a rear structure of a remote controller in Mode 2 according to another embodiment of the present invention.
Figure 7:
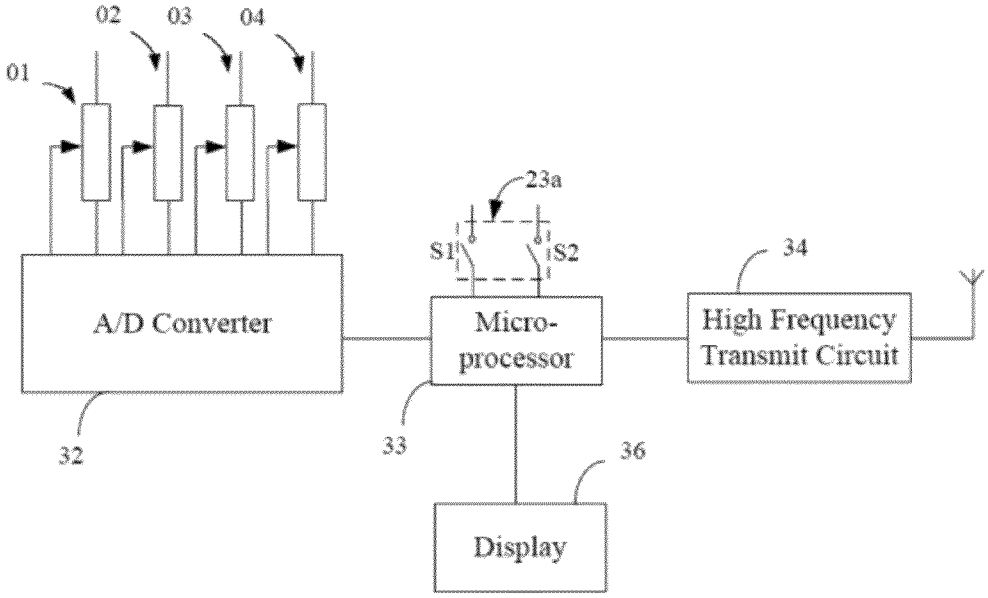
FIG. 7 illustrates a block diagram of an internal circuit structure of a remote controller according to another embodiment of the present invention.

FIGS. 5A and 5B illustrate schematic diagrams of a rear structure of a remote controller according to another embodiment of the present invention. An antenna 35*a* of the remote controller 200*a* of this embodiment is provided on the back of the body 20*a*, and may be rotated by 180° around a shaft 25. The mode selection switch 23*a* is a combination of two pressing switches S1 and S2. The antenna 35*a* points to the upside of side A or B when the remote controller is in use. The antenna 35*a* will press one of the two switches, while the other switch is in a released state. Referring to Table 2, it illustrates the relations among the states of the switches and the manipulation modes as well as the channels. Referring to FIG. 7, the micro-processor 33 will determine the manipulation mode in which to operate according to the pressed or released states of the two switches S1 and S2, and process the data accordingly.

TABLE 2

| Relations among switch states, manipulation modes and channels | | | | | | | | | |
|---|---|---|---|---|---|---|---|---|---|
| | | Switch State | | | | | | | |
| | | S1 pressed, S2 released | | | | S1 released, S2 pressed | | | |
| | | Manipulation Mode | | | | | | | |
| | | Mode 1 | | | | Mode 2 | | | |
| Channel corresponding to the signal | Manipulation Signal | VR1 | VR2 | VR3 | VR4 | VR1 | VR2 | VR3 | VR4 |
| | Channel | 1 | 2 | 3 | 4 | 4 | 2 | 3 | 1 |
| | Manipulation Signal Direction | Normal | Normal | Normal | Normal | Reversed | Reversed | Reversed | Reversed |

This embodiment has the advantages that the appearance is intuitive and apparent. As long as the antenna points to the forward (or upward), it is in the correct manipulation mode. With the design of switching the modes by a small switch, it is relatively arduous to observe which mode is in.

In order to prevent from changing the manipulation mode unconsciously, an antenna locking means may be added in this embodiment, as the antenna fixer 19 shown in FIGS. 5A and 5B, to lock the antenna. The antenna may be turned only by disassembling the screw with a normal small screwdriver.

Of course, other mechanical components, such as various specific covers that may be unlocked and locked, may be employed to protect the mode switching switch. For example, remote controller handles for both Mode 1 and Mode 2 may be designed, and fixed on side A or side B of the remote controller, respectively. The sections on side A or side B of the remote controller fixed with the handles may be mounted with switching switches.

As described above, the remote controller for aircraft models of the present invention achieves the simple switching of the remote controller between two popular manipulation modes by smart mechanical structure design in association with necessary electric signal transitions. All these processes do not require the modification of the mechanical structure of the remote controller, so the operation complexity is reduced and the operation time is saved. It is worth to mention that, the present invention enable the remote controllers for aircraft models not to be manufactured in terms of the manipulation modes. Thus, the designs and manufactures of the two types of remote controllers are unified, thus reducing the manufacture cost.

The aircraft models described in the present invention include the models designed for amateur, as well as the aircraft model toys that are increasing popular.

Although the present invention has been disclosed above in terms of the preferred embodiments, it is not intended to limit the present invention. Some modifications and improvements may be made by those skilled in the art without departing from the scope of the present invention. Therefore, the scope of the present invention should be construed as defined by the claims.

What is claimed is:

1. A remote controller for an aircraft model, comprising:

a body configured with a first joystick and a second joystick for respectively manipulating potentiometers to rotate to issue manipulation signals in two manipulation channels, wherein the body is configured to be held in a first direction and a second direction respectively, the first direction corresponds to a first manipulation mode of the remote controller, the second direction corresponds to a second manipulation mode of the remote controller, and the first direction is opposite to the second direction;

a plurality of fine tuning buttons corresponding to the manipulation channels manipulated by the first joystick and the second joystick and configured to finely tune the manipulation signals;

a mode selection switch configured to issue a mode selection signal; and a signal acquisition unit for acquiring the manipulation signals manipulated by the first joystick and the second joystick, and processing the manipulation signals according to the mode selection signal, wherein the signal acquisition unit processes the manipulation signals according to the first manipulation mode when the first manipulation mode is selected by the mode selection switch, and the signal acquisition unit processes the manipulation signals according to the second manipulation mode when the second manipulation mode is selected by the mode selection switch, wherein the mode selection switch comprises a first switch and a second switch provided on back of the body of the remote controller, and an antenna of the remote controller is configured to rotate around a shaft on the back of the body, wherein the antenna presses the first switch while pointing to the first direction and presses the second switch while pointing to the second direction, and the remote controller is in the first manipulation mode when the first switch is pressed and in the second manipulation mode when the second switch is pressed.

2. The remote controller for an aircraft model according to claim 1, characterized in that the first joystick manipulates a power of momentum of the aircraft model in forth-back direction, and the second joystick manipulates rise or fall of the aircraft model in forth-back direction.

3. The remote controller for an aircraft model according to claim 1, characterized in that the mode selection switch is an electric switch.

4. The remote controller for an aircraft model according to claim 1, characterized in that the first manipulation mode is Mode 1, and the second manipulation mode is Mode 2.

5. The remote controller for an aircraft model according to claim 1, characterized in that a first right-left signal and a first forth-back signal are generated when the first joystick is manipulated, and a second right-left signal and a second forth-back signal are generated when the second joystick is manipulated, wherein when the signal acquisition unit processes the signals according to the first manipulation mode, the first right-left signal corresponds to Channel 1 of the remote controller, the first forth-back signal corresponds to Channel 3 of the remote controller, the second right-left signal corresponds to Channel 4 of the remote controller, and the second forth-back signal corresponds to Channel 2 of the remote controller; and when the signal acquisition unit processes the signals according to the second manipulation mode, the first right-left signal corresponds to Channel 4 of the remote controller, the first forth-back signal corresponds to Channel 3 of the remote controller, the second right-left signal corresponds to Channel 1 of the remote controller, the second forth-back signal corresponds to Channel 2 of the remote controller and the manipulation signals are reversed.

6. The remote controller for an aircraft model according to claim 5, characterized in that the first joystick and the second joystick are coupled to four potentiometers which generate the first right-left signal, the first forth-back signal, the second right-left signal, and the second forth-back signal according to manipulations of the first joystick and the second joystick.

7. The remote controller for an aircraft model according to claim 1, characterized in that the fine tuning buttons comprise:

a set of fine tuning buttons of inner of the first joystick for finely tuning a middle point of the first forth-back signal of the first joystick;

two sets of fine tuning buttons provided above and below the first joystick respectively for finely tuning a middle point of the first right-left signal of the first joystick;

a set of fine tuning buttons of inner of the second joystick for finely tuning a middle point of the second forth-back signal of the second joystick; and two sets of fine tuning buttons provided above and below the second joystick respectively for finely tuning a middle point of the second right-left signal of the second joystick.

8. The remote controller for an aircraft model according to claim 4, characterized in that the signal acquisition unit comprises:

an analog/digital converter circuit coupled to four potentiometers for converting the first right-left signal, the first forth-back signal, the second right-left signal, and the second forth-back signal generated by the four potentiometers into digital signals; and a micro-processor coupled to the analog/digital converter circuit and the mode selection switch for processing the first right-left signal, the first forth-back signal, the second right-left signal, and the second forth-back signal according to the manipulation mode selected by the mode selection signal.

9. The remote controller for an aircraft model according to claim 1, characterized in that an antenna locking means is disposed to lock the antenna such that the antenna can be turned only by disassembling screw with a normal small screwdriver.

* * * * *